United States Patent [19]

Dassler

[11] Patent Number: 4,578,883

[45] Date of Patent: Apr. 1, 1986

[54] PAIR OF SHOES FOR THE SPORT OF CURLING

[75] Inventor: Armin A. Dassler, Herzogenaurach, Fed. Rep. of Germany

[73] Assignee: Puma-Sportschuhfabriken Rudolf Dassler KG, Fed. Rep. of Germany

[21] Appl. No.: 638,115

[22] Filed: Aug. 6, 1984

[30] Foreign Application Priority Data

Aug. 8, 1983 [DE] Fed. Rep. of Germany ..... 3328545

[51] Int. Cl.[4] ..... A43B 5/16; A43B 5/00

[52] U.S. Cl. ..... 36/116; 36/115; 36/59 C; 36/25 R

[58] Field of Search ..... 36/103, 115, 116, 124, 36/32 R, 77 R, 59 C, 31, 25 R, 113, 114

[56] References Cited

U.S. PATENT DOCUMENTS

| | | | |
|---|---|---|---|
| 1,138,684 | 5/1915 | Neeley | 36/113 |
| 1,984,989 | 12/1934 | Reed | 36/25 R |
| 2,142,458 | 7/1938 | Buckler | 36/8.3 |
| 2,746,175 | 5/1956 | Root | 36/8.3 |
| 2,751,691 | 6/1956 | Clark, Jr. | 36/77 R |
| 3,195,244 | 7/1965 | Whitcas | 36/130 |
| 3,281,971 | 11/1966 | Weitzner | 36/2.5 |
| 4,012,855 | 3/1977 | Gardner | 36/29 |
| 4,245,406 | 1/1981 | Landay et al. | 36/32 R |
| 4,281,467 | 8/1981 | Anderie | 36/59 C |

FOREIGN PATENT DOCUMENTS

| | | | |
|---|---|---|---|
| 196749 | 8/1957 | Austria | 36/59 C |
| 1138194 | 12/1982 | Canada | 36/25 R |
| 1736511 | 12/1956 | Fed. Rep. of Germany . | |
| 1918612 | 5/1965 | Fed. Rep. of Germany . | |
| 1334758 | 7/1963 | France . | |
| 7811065 | 5/1979 | Netherlands | 36/77 R |
| 456392 | 7/1968 | Switzerland . | |
| 3664 | of 1876 | United Kingdom | 36/59 C |
| 1478 | of 1883 | United Kingdom | 36/31 |

OTHER PUBLICATIONS

Letter from Adidas to German Patent Office dated Sep. 20, 1983.

*Primary Examiner*—Werner H. Schroeder
*Assistant Examiner*—Steven N. Meyers
*Attorney, Agent, or Firm*—Sixbey, Friedman & Leedom

[57] ABSTRACT

A pair of shoes for the sport of curling, according to the invention, has a first one of the shoes developed as a sliding shoe with a sole or a sole surface having a sliding area comprised of at least supporting areas of a material with a low coefficient of friction with respect to ice, and the other shoe formed as a run-up and drag shoe having a sole or a sole surface with at least tread areas of a material that has a high coefficient of friction with respect to ice, at least relative to that of the first shoe, and at least an outer surface of the toe cap of the upper being formed of a material that has a low coefficient of friction with respect to ice.

28 Claims, 8 Drawing Figures

FIG. 1
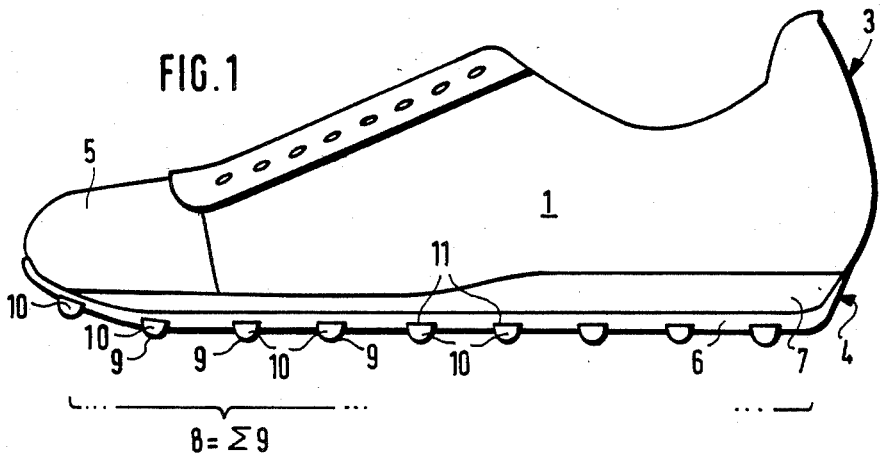
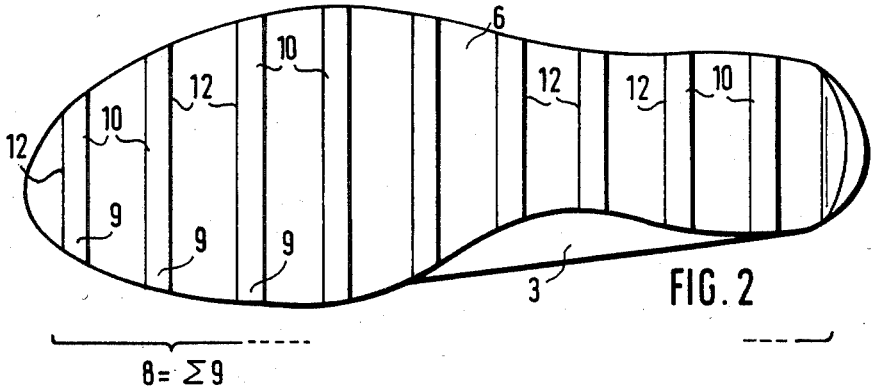
FIG. 2
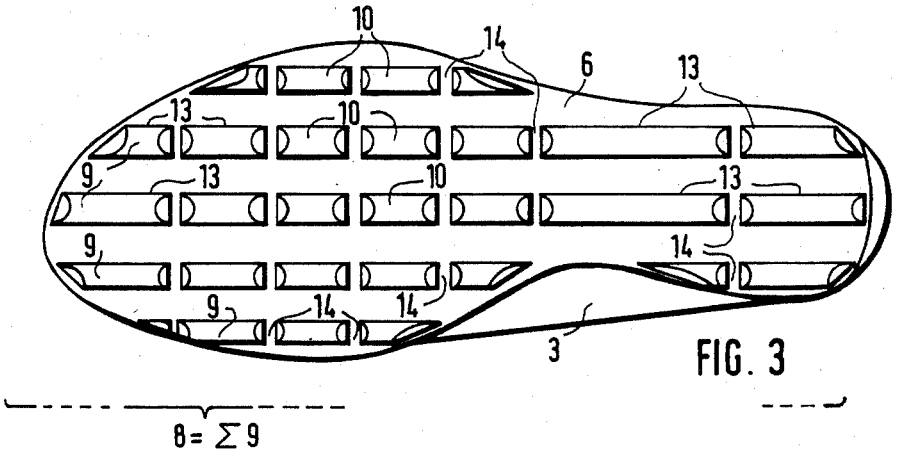
FIG. 3

PAIR OF SHOES FOR THE SPORT OF CURLING

BACKGROUND AND SUMMARY OF THE INVENTION

It is known that in curling the player, after a run-up stretch, slides toward the goal with the curling stone. In front of a line marking the end of the sliding stretch, the player releases the curling stone after having given it the exact direction and speed. During the sliding phase, the player takes up an almost kneeling position by placing one leg, in a bent position, in front and sliding with that leg on the sole of the shoe. At the same time, the other leg is placed, in a bent position, toward the back and with the shoe tucked under for sliding on the cap of the toe part of the shoe of that leg that is dragged behind, without the knee of that leg touching the ice. During this phase, the shoes should not impair the player's ability to slide and should not scratch the ice. Currently, conventional winter shoes or hiking boots are still used for this sport.

By means of the present invention, the objective is to be achieved, among other things, of optimally adapting a pair of shoes to the differing requirements for each shoe that occur during play in the sport of curling.

This objective is achieved by a pair of shoes having one shoe formed to serve as a sliding shoe by having a sole with a sliding surface of a low coefficient of friction relative to ice and another shoe adapted to serve as a run-up and drag shoe having sole with tread areas of a high coefficient of friction relative to ice and a toe cap having a low coefficient of friction relative to ice.

By means of the measures according to the invention, an optimal sliding of the player with the sliding shoe is possible during the sliding phase, and in addition, the player, during the run-up, has a better acceleration by means of the run-up and drag shoe. In this case, the ice is not damaged, and the flexibility of the soles is not impaired. The shoes may be designed to absorb heat and shocks, and may be developed as sports shoes, especially in the way of running shoes, namely to be very light. The sliding elements forming the sliding surface may have different weight distributed on them so that a change of direction is possible still during the sliding phase.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

BRIEF DESCRIPTION OF THE DRAWINGS

FIG. 1 is a lateral view of a sliding shoe of the pair of shoes;

FIGS. 2 thru 4 each show a sole of the sliding shoe from the bottom;

FIG. 4*a* is a sectional view along line A—A of FIG. 4.

DETAILED DESCRIPTION OF THE PREFERRED EMBODIMENTS

Figure 4:
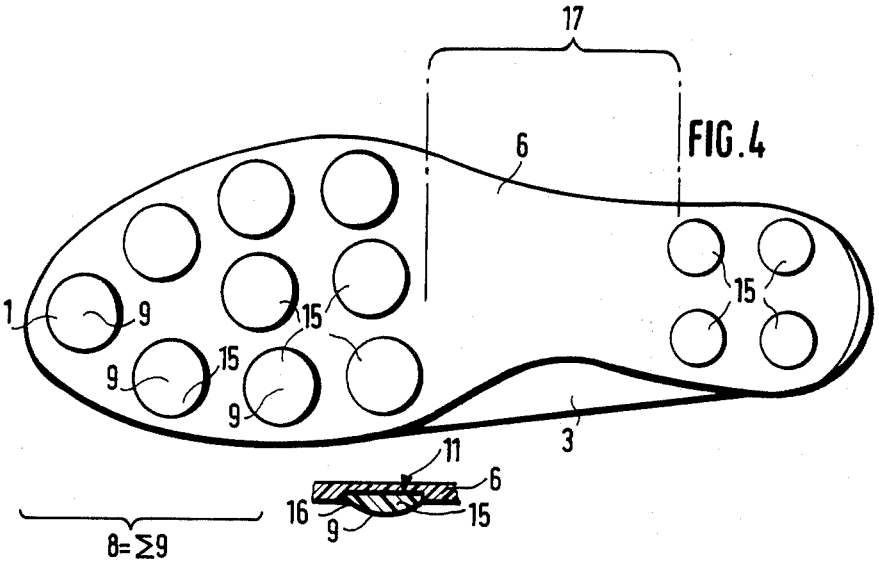
Figure 5:
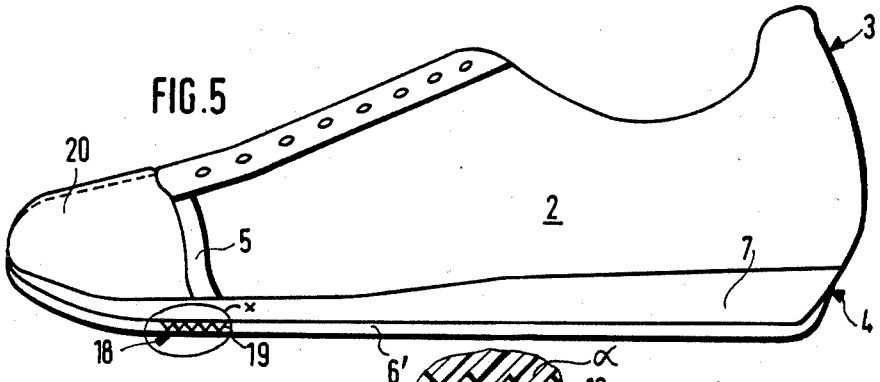
FIG. 5 is a lateral view of a run-up and drag shoe and FIGS. 5*a* and 5*b* are enlarged views of detail "x" of FIG. 5 showing alternative profiles.
Figure 6:
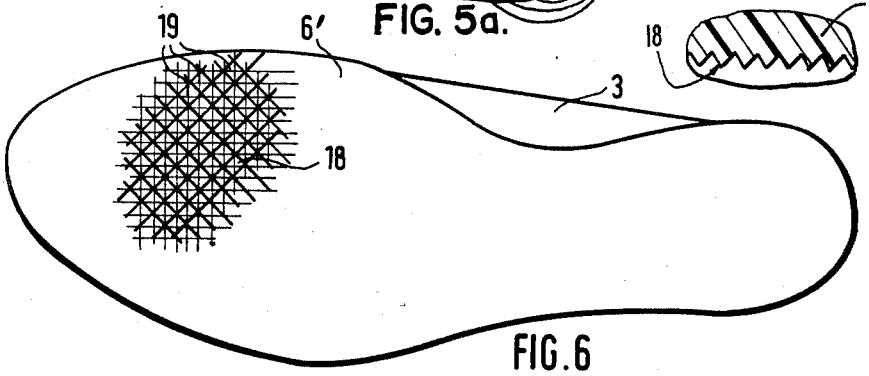
FIG. 6 is a bottom view of the shoe of FIG. 5.

According to the invention, the pair of shoes consists of a sliding shoe 1 (FIGS. 1–4) and a run-up and drag shoe 2 (FIGS. 5 and 6). In the case of right-handed players, the left shoe is usually developed as the sliding shoe and the right one as the run-up and drag shoe. The majority of shoes according to the invention will, therefore, be developed in that way, and a smaller number will be made where the left shoe is the run-up and drag shoe and the right one is the sliding shoe.

According to the invention, the sliding shoe 1 consists of an upper 3 and a sole 4. The upper 3 may be provided with a toe cap 5.

The sole 4 consists of an outer sole 6, made of an elastic material and, advantageously, of a midsole 7. The midsole 7 is made of a shock-absorbing material, such as a form rubber or foamed synthetics and, preferably, has a wedge-shape. At the same time, the material of the midsole 7, advantageously, also posseses effective low-temperature-insulating characteristics, such being the case with the already mentioned foam rubber or elastic foamed synthetic material.

The outer sole 6, or its bottom surface, has a sliding surface 8 formed on a number of individual areas of support 9. The support areas 9 are formed of a material that slides very well on ice and thus, with respect to the ice, has a very low coefficient of sliding friction. In particular, these support areas 9 on the surface 8 are developed to be especially smooth.

Preferably, the support areas 9 are provided on special, pad- or rib-like, elevations that are integrally formed with the outer sole 6 or are formed by special inserts 10 that placed in indentations 11 of the outer sole 6 and firmly connected, especially glued and/or bonded to said outer sole 6. Advantageously, the walls of the indentations 11, toward the inside, diverge diagonally apart and the inserts 10 conform to this shape so that a type of tongue-and-groove guidance or a key-groove-type form-fitting frictional connection is provided.

According to FIG. 2, the inserts 10 are constructed in the form of transverse ribs 12. This affords a high degree of bending elasticity to the outer sole 6 in the direction of movement of the foot and, at the same time, a stable lateral guidance. Furthermore, when the inserts 10 consist of a rigid or relatively rigid material, such as rigid PVC, polyurethane, polyethyleneterephthalate, polytetrafluoroethylene (known under the trademark "Teflon"), polyamide, synthetic resin/glass fiber mixtures, aluminum or hard materials, such as silicon carbide.

FIG. 3 shows a possible alternate embodiment wherein the inserts 10 are in the form of longitudinal ribs. In this case, the inserts 10 are constructed in the form of longitudinal rib sections 13 in order to ensure that, despite the use of a rigid or relatively rigid material, a good bending of the outer sole 6, in the above-mentioned manner is possible. That is, the interruptions 14 are provided between rib sections at the preferred natural bending points, such as, especially, in the area of the ball of the foot. However, the interruptions may also be spaced over the whole length of the sole. Longitudinal ribs will, preferably, be used when a bending of the outer sole 6 is also desired transversely (about a longitudinal axis) as well as about the noted natural bending (about transverse axes).

At their longitudinal ends, the rib sections 13 of the longitudinal ribs are diagonally beveled or cambered, i.e. are outwardly rounded, in order to avoid a scratching of the ice.

Another possible embodiment for the sliding shoe is the arrangement of inserts 10 as shown in FIGS. 4, 4*a*. In this case, the inserts 10 are provided in the shape of molded-on or inserted circular disks or pads 15 having convex outer surfaces 16 (see FIG. 4*a*). Instead of the circular shape shown for disks 15, other shapes may be utilized, such as rectangles, ellipses, etc., and they may, according to the stress to which they are to be subjected and according to the surface of the sole, be of different sizes, and they may be omitted in certain areas, such as in the area 17 at the arch of the foot.

In order to achieve good sliding characteristics, it is advantageous to make the surface of the inserts 10 convex or to otherwise provide them with a rounded outer profile. For example, it is advantageous to develop the ribs 12, 13 to have an approximately semicircular cross-sectional shape.

It is beneficial for the support areas 9 to be especially smooth in order to achieve very low frictional forces.

The surface of the outer sole 6 may, apart from support areas 9, be smooth or have any profile since it has no influence on how the sport is carried out.

In contrast to the sliding shoe 1, having good sliding characteristics on ice, the run-up and drag shoe 2 (FIGS. 5 and 6) has a sole 6' which completely, or at least on the outer surface, consists of a material that does not slide well on ice or at least has sliding characteristics that are much worse than those of the material of the outer sole 6 or of the inserts 10 of the sliding shoe 1. In order to make the friction as high as possible, the sole 6' is provided with a tread profiling 18 (only a portion of which is illustrated, for simplicity) that has good gripping characteristics. However profiling 18 must not scratch the surface of the ice. The material must, therefore, be sufficiently soft and preferably also elastically deformable in order to permit, for example, a bending of the sole corresponding to the running motion of the foot.

Figure 5A:
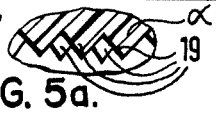
Figure 5B:
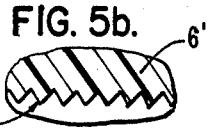

A fine ribbing is, advantageously, used as the tread profile 18 of the sole 6', having, for example, a distance of 6 mm or less from one upper edge of the ribbing to the next (FIG. 5*b*). The profile may also consist of a plurality of pyramids or cones 19, as shown in a partial area of the sole 6' in FIGS. 5*a* and 6. Advantageously, this tread profiling 18 is arranged and developed in such a way that, if possible, no snow can settle in the profile. This is, for example, achieved or facilitated by forming the included edge angle of the upper edge of the ribbing, that is, the apex angle $\alpha$ of the pyramids 19 or the cones, to be larger than 60 degrees, preferably larger than 70 degrees.

As the material for the sole 6', soft PVC, soft rubber, non-rigid polyurethane, etc. are preferably used.

In addition, to the special profiling 18 and selection of material of the sole 6' of the run-up and drag shoe 2, according to the invention, the toe area of the shoe is constructed as a sliding shell, such as a cap shell 20, which has a relatively hard, smooth, especially glossy or highly glossy surface, and is formed of a material that has good sliding characteristics on ice.

Advantageously, the same or a similar material is used as the one used for the inserts 10, such as rigid PVC, rigid polyurethane, polyester, synthetic resin/-glass fiber mixtures, aluminum or a similar material.

Preferably, the cap shell 20 extends over the whole extent of the toe cap of the shoe and is, advantageously, applied over a shoe cap 5 as is normally found in the case of athletic shoes. It may be glued on, riveted on, or may be rigidly or detachably fastened on the upper 3 by means of detachable connecting elements, such as snap fasteners or locking elements. For this purpose, the cap shell 20 is shaped to conform to the toe of the shoe or to a shoe cap 5, so that it can be placed on it or fitted on it, practically without a gap. The cap shell 20 may be fastened on the upper 3 during the manufacture of said upper 3, or it may be attached subsequently. The cap shell 20 ensures a good sliding on ice and also forms a protection against wear of the cap 5 of the shoe or the tip of the upper of the shoe 3, when it is tucked-under and dragged during the sliding phase, noted, initially, in the background portion of this application.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. A pair of shoes for the sport of curling, comprising a first shoe, developed as a sliding shoe, having a sole that has at least a surface thereof constructed as a sliding surface, at least support areas of the sliding surface being formed of a material that has a low coefficient of friction with respect to ice, and a second shoe, developed as a run-up and drag shoe, having a sole, at least a sole surface of which comprises tread areas of a material that has a high coefficient of friction, at least relative to the coefficient of friction of the support areas of the first shoe, with respect to ice, and a toe area of an upper of which has at least a surface of a material that has a low coefficient of friction with respect to ice similar to that of the sliding surface material of the sole of the sliding shoe for sliding on when the second shoe is tucked unser and dragged.

2. A pair of shoes according to claim 1, wherein said shoes have outer soles that are applied onto a thermal-insulating midsole.

3. A pair of shoes according to claim 1, wherein said shoes have outer soles applied onto midsoles, said midsoles being of a material having good shock-absorbing properties.

4. A pair of shoes according to claim 1, wherein said shoes have outer soles applied onto midsoles formed of a thermal-insulating and shock-absorbing material.

5. A pair of shoes according to claim 1, wherein the shoes are constructed like running shoes of the type having an upper attached to a sole, the sole being formed of an outer side of elastic material and a mid-sole made of a shock-absorbing material.

6. A pair of shoes according to claim 1, wherein the sole of the sliding shoe is comprised of an elastically deformable material and is provided with elevations serving as said support areas and that have good sliding characteristics.

7. A pair of shoes according to claim 6, wherein the elevations consist of inserts made of a material that has a low coefficient of friction with respect to ice, said inserts being firmly connected with the sole.

8. A pair of shoes according to claim 7, wherein the inserts are inserted into indentations of the sole.

9. A pair of shoes or a sliding shoe according to claim 8, wherein the inserts, in top view, are selected from the group of shapes consisting of rectangles, circles, elipses, and other similar geometric shapes, and have surfaces, forming said sliding surface, that bow outwardly.

10. A pair of shoes according to claim 8, wherein walls of the indentations, in an inward direction, diverge diagonally apart, and the inserts are provided with the correspondingly shaped surfaces in order to form a key-groove-shaped form-fitting frictional connection with the indentations.

11. A pair of shoes according to claim 7, wherein the inserts are provided in the form of transverse ribs so that a bending of the sole is possible at least in an area of the shoe corresponding to the ball of the foot.

12. A pair of shoes according to claim 11, wherein the ribs have cross-sectionally convex outer surfaces.

13. A pair of shoes according to claim 11, wherein ends edges of the ribs are tapered.

14. A pair of shoes or a sliding shoe according to claim 7, wherein the inserts are provided in the form of longitudinal rib sections which are interrupted at foot-dependent bending points of the sole, so that a bending of the sole is possible at least in the area of the shoe corresponding to the ball of the foot.

15. A pair of shoes according to claim 14, wherein the ribs have a cross-sectionally convex outer surface.

16. A pair of shoes according to claim 14, wherein end edges of the ribs are tapered.

17. A pair of shoes according to claim 6, wherein the elevations are formed of a material that has a low coefficient of friction with respect to ice.

18. A pair of shoes according to claim 17, wherein the elevations are formed of a material selected from the group consisting of rigid PVC, polyurethane, polyethyleneterephthalate, polytetrafluoroethylene, SiC, and aluminum.

19. A pair of shoes according to claim 1, the sole of the run-up and drag shoe is formed of an elastically deformable material and has a profile with good gripping characteristics.

20. A pair of shoes according to claim 19, wherein the profile of the sole of the run-up and drag shoe is composed of a fine ribbing.

21. A pair of shoes according to claim 20, wherein an apex angle, between sides of respective ribs of the ribbing, is larger and 70 degrees.

22. A pair of shoes according to claim 21, an apex angle of the pyramids or cones is larger than 70 degrees.

23. A pair of shoes according to claim 19, wherein the profile of the sole of the run-up and drag shoe has the shape of small pyramids or cones.

24. A pair of shoes according to claim 19, wherein said surface of the toe area of the run-up and drag shoe comprises a cap shell conforming to the shape of the toe area and is fastened thereto, said cap shell being formed of a material that has a low coefficient of friction with respect to ice.

25. A pair of shoes according to claim 24, wherein the cap shell is glued onto the upper.

26. A pair of shoes according to claim 24, wherein the cap shell is detachably fastened to the upper of the run-up and drag shoe.

27. A pair of shoes according to claim 24, wherein the cap shell has a smooth, especially glossy to highly glossy outer surface.

28. A pair of shoes according to claim 24, wherein the cap shell is formed of a plastic material, selected from the group consisting of rigid PVC, rigid polyurethane, polyester, polyepoxide, with or without mineral fibers mixed therein, and aluminum.

* * * * *